United States Patent [19]

Langley

[11] Patent Number: 4,909,360

[45] Date of Patent: Mar. 20, 1990

[54] BRAKE EQUIPMENT

[75] Inventor: Keith W. Langley, Swainswick, England

[73] Assignee: Westinghouse Brake and Signal Holdings Limited, Wiltshire, England

[21] Appl. No.: 343,736

[22] Filed: Apr. 27, 1989

[30] Foreign Application Priority Data

Jun. 28, 1988 [GB] United Kingdom ..... 8815374

[51] Int. Cl.[4] ..... F16D 65/66

[52] U.S. Cl. ..... 188/203; 188/153 R

[58] Field of Search ..... 188/52, 56, 153 A, 153 R, 188/196 D, 196 BA, 197, 202, 203

[56] References Cited

U.S. PATENT DOCUMENTS 2,656,018 10/1953 Bent et al. ..... 188/197

3,017,960 1/1962 Hursen et al. ..... 188/203 X

FOREIGN PATENT DOCUMENTS 1205563 8/1959 France ..... 188/203

*Primary Examiner*—Duane A. Reger

*Attorney, Agent, or Firm*—Marshall, O'Toole, Gerstein, Murray & Bicknell

[57] ABSTRACT

A tread-brake unit comprises a brake piston and arrangement (101/100), a slack adjuster (200) and a brake shoe (300). The piston (101) is mounted in the cylinder (100) such that in operation of the brake piston and cylinder arrangement the axis (103) of the piston (101) oscillates about the axis (104) of the cylinder (100). The axis (104) of the cylinder (100) is inclined with respect to the axis (201) of the slack adjuster (200) in the plane in which the axis (103) of the piston (100) is oscillatable about the axis (104) of the cylinder (100). The piston rod (105) of the piston (101)is pivotally engaged with one end of a first lever (401) pivotally mounted in the unit and engageable with one end of a second, bell-crank, lever (410) which is pivotally mounted at its elbow in the unit and is pivotally engaged at its other end to a part (280) of the slack adjuster (200) movement of which within the unit effects, through the slack adjuster (200), operation of the brake shoe (300).

2 Claims, 1 Drawing Sheet

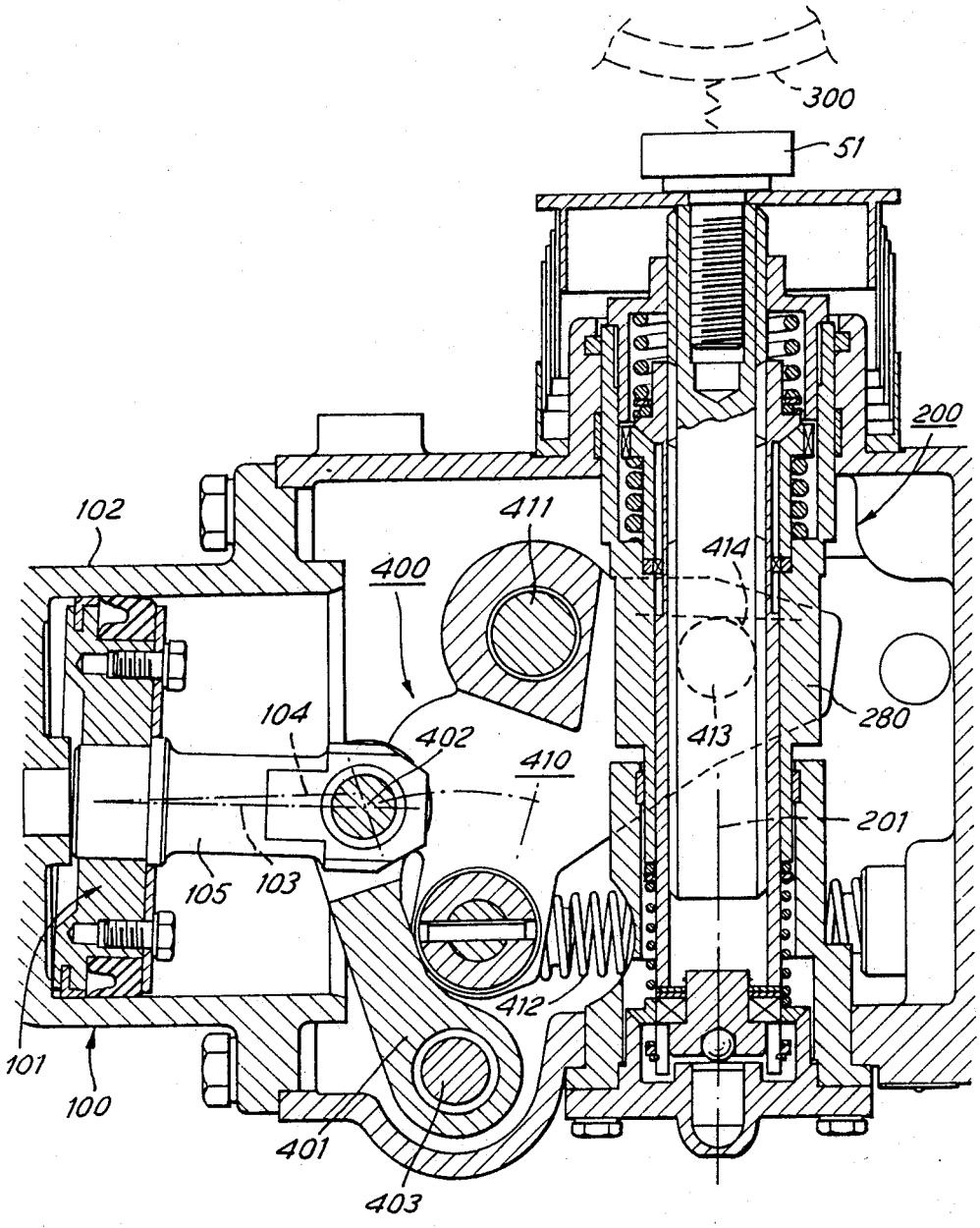
300
51
200
102
411
414
400
280
104
402
413
410
201
105
103
412
101
100
401
403

BRAKE EQUIPMENT

BACKGROUND OF THE INVENTION

1. Field of the Invention:

This invention relates to brake equipment and, more particularly to railway brake equipment known as "tread-brake units".

2. Description of the Prior Art

A tread-brake unit is a self-contained braking equipment comprising, in combination, a brake cylinder and a brake shoe. In some instances, the unit may also incorporate a slack adjuster. By the manner of positioning of tread-brake units, the envelope available for the unit is frequently very limited and, therefor, the design of tread-brake units is somewhat difficult. The difficulty is the greater if the unit is required to incorporate a slack adjuster.

SUMMARY OF THE INVENTION

According to the present invention there is provided a tread-brake unit comprising a brake piston and cylinder arrangement, a slack adjuster and a brake shoe; wherein the piston of the brake piston and cylinder arrangement is mounted in the cylinder of the arrangement such that in operation of the arrangement, the axis of the piston oscillates about the axis of the cylinder; wherein the axis of the cylinder is inclined with respect to the axis of the slack adjuster in the plane in which the axis of the piston is oscillatable about the axis of the cylinder and wherein the piston rod of the piston is pivotally engaged with one end of a first lever pivotally mounted in the unit, this first lever being engageable with one end of a second, bell-crank, lever which is pivotally mounted at its elbow in the unit and is pivotally engaged at its other end with a part of the slack adjuster, movement of which within the unit effects, through the slack adjuster, operation of the brake shoe.

For a better understanding of the invention and to show how the same may be carried into effect, reference will now be made by way of example, to the accompanying drawing in which the single figure is a cross-sectional view of a tread-brake unit

DESCRIPTION OF THE PREFERRED EMBODIMENT

The tread-brake unit shown in the FIGURE includes a brake cylinder 100, a slack adjuster 200 and a brake shoe 300 (shown only schematically).

The brake cylinder 100 is of the type in which, in operation, a piston 101 oscillates in a cylinder 102 during its stroke such that the axis 103 of the piston 101 oscillates in the plane of the drawing about the axis 104 of the brake cylinder 100.

The slack adjuster 200 is of the type described in more detail in U.S. patent applications Nos. 299,386 and 300,107 and will not be described herein save to note that the part referenced 280 in the drawing accompanying this Application is the equivalent of the tubular piston rod 8 referred to in the copending Applications, this part being the part movement of which within the unit effects, through the slack adjuster, operation of the brake shoe 300.

The brake shoe 300 is of the construction of the brake shoe 300 shown in the Applications just mentioned, the cross-head referenced 51 in the drawing accompanying this Application being the cross-head similarly referenced in the mentioned Application.

It will be seen from the accompanying drawing that the axis 201 of the slack adjuster 200 is inclined at right angles to the axis 104 of the brake cylinder 100, also in the plane of the drawing.

To effect operation of the brake shoe 300 via the slack adjuster 200 by the brake cylinder 100, the brake cylinder 100 and the slack adjuster 200 are interconnected by a lever system 400. This system includes a first (first order) lever 401 pivotally connected at one end via a pin 402 to the piston rod 105 of the piston 101 of the brake cylinder 100 and pivotally mounted in the tread-brake unit at its other end by a pin 403. The system 400 further includes a second (second order) bell-crank lever 410 pivotally mounted at its elbow via a pin 411 in the tread-brake unit. The bell-crank lever 410 is resiliently loaded by a spring 412 such that one end of the bell-crank lever 410 is engaged with the first lever 401 mid-way between the pins 402 and 403. Adjacent its other end, the bell-crank lever 410 carries a roller 413 which bears against a shoulder 414 on the part 280 of the slack adjuster 200.

Reciprocation of the piston 101 of the brake cylinder 100 to effect application and release of the brakes pivots the lever 401 about pin 403 with the axis 103 of the piston 101 oscillating about the axis 104 of the brake cylinder 100. By virtue of its engagement by the bell-crank lever 410 (pivoting of the lever 401) pivots the bell-crank lever 410. Pivoting of the bell-crank lever 410 causes reciprocation of the part 280 of the slack adjuster 200. Reciprocation of the part 280, as described in the Applications mentioned above, reciprocates the tubular piston rod 8 to effect operation of the brake shoe 300 to apply and release the brakes and also effects, as necessary, operation of the slack adjuster 200 to take up any excess slack.

I claim:

1. A tread-brake unit comprising a brake piston and a brake cylinder arrangement, a slack adjuster and a brake shoe; wherein the piston of the brake piston and cylinder arrangement is mounted in the cylinder of the arrangement such that in operation of the arrangement the axis of the piston oscillates about the axis of the cylinder; wherein the axis of the cylinder is inclined with the respect to the axis of the slack adjuster in the plane in which the axis of the piston is oscillatable about the axis of the cylinder; and wherein the piston rod of the piston is pivotally engaged with one end of a first lever pivotally mounted in the unit, this first lever being engageable with one end of a second, bell-crank lever which is pivotally mounted at its elbow in the unit and is pivotally engaged at its other end with a part of the slack adjuster, movement of which within the unit effects, through the slack adjuster, operation of the brake shoe.

2. A tread-brake unit as claimed in claim 1, wherein the axis of the cylinder of the piston and cylinder arrangement is inclined at right angles to the axis of the slack adjuster.

* * * * *